United States Patent [19]

Delery

[11] Patent Number: 4,624,063

[45] Date of Patent: Nov. 25, 1986

[54] SKI BOOT WITH SERRATED CLAMPING STRAP

[75] Inventor: Marc Delery, Caluire, France

[73] Assignee: Compagnie Francaise d'Articles de Sport, France

[21] Appl. No.: 670,904

[22] Filed: Nov. 13, 1984

[30] Foreign Application Priority Data

Nov. 10, 1983 [FR] France ..... 83 18162

[51] Int. Cl.[4] ..... A43B 5/04; A43B 11/00

[52] U.S. Cl. ..... 36/117; 36/50; 36/120; 24/68 SK; 24/70 SK

[58] Field of Search ..... 36/117–121, 36/50; 24/68 SK, 69 SK, 70 SK, 71 SK

[56] References Cited

U.S. PATENT DOCUMENTS 4,304,055 12/1981 Hanson ..... 36/50
4,387,517 6/1983 Annovi ..... 36/117
4,470,175 9/1984 Chiarella ..... 24/70 SK

FOREIGN PATENT DOCUMENTS 0071055 2/1983 European Pat. Off. .
2358848 2/1978 France .
2498431 7/1982 France .

*Primary Examiner*—James Kee Chi
*Attorney, Agent, or Firm*—Parkhurst & Oliff

[57] ABSTRACT

The invention relates to a ski boot of the type comprising a shell, at least one spoiler and clamping means constituted by a lever, a clamping member, a toothed piece designed to cooperate with said clamping member, and wherein the toothed piece is housed between two parallel side walls molded with the boot, and defining between them an open chamber on the edge of the spoiler or of the shell, and the height of which substantially coincides with the height of the toothed piece;

and the end of said chamber:

is, on the one hand, extended at the top by a streamlined structure which is progressively joined to the front of the spoiler or of the shell;

and on the other hand, comprises a split part, perpendicular to the walls and situated plumb with the beginning of said streamlined structure.

2 Claims, 7 Drawing Figures

SKI BOOT WITH SERRATED CLAMPING STRAP

The present invention relates to a new type of ski boot made from plastic material.

BACKGROUND OF THE INVENTION

Generally, a ski boot in plastic material essentially comprises:

a shell designed to receive the foot;

a front spoiler designed to enclose the leg, and being pivotally mounted on the shell;

means of clamping the shell and spoiler on the foot and leg.

A number of clamping systems have been proposed up to now. A first one uses a level combined with a closed loop forming a clamping member engaging into hooks (see applicant's U.S. Pat. No. 4,150,500). This solution, although well known, has the disadvantage of requiring closing forces which increase as one moves away from the rotation axis of the lever with respect to its base.

In a second system, the clamping member is constituted by a rack buckle essentially composed of a lever, a serrated strap forming fastening member and a catch designed to cooperate with the teeth of the strap (see for example U.S. Pat. No. 3,662,435). In practice with this latest system, which is also commercialized with success, the lever is associated to the strap by a toggle joint system which permits to reduce the force. Unfortunately, this solution presents considerable disadvantages, and in particular:

when the catch is constructed with releasing kinematics, any accidental shock can cause it to open;

the free end of the strap which juts out of the catch forms a projection so that, when the skier is walking, the strap end of one boot can get caught with that of the other boot;

snow can be caught under the catch, this impeding its opening;

depending on the morphology of the skier's leg and foot, the straps extend more or less out of said catch, this increasing the risks of the strap ends becoming entangled between the two feet;

finally, this system is apparent and therefore does little for the appearance of the boot.

BRIEF SUMMARY OF THE INVENTION

It is the object of the present invention to overcome the aforesaid disadvantages by proposing a ski boot with a clamping system which has an improved appearance and has none of the aforementioned drawbacks.

The ski boot made of plastic material essentially comprises:

a shell designed to receive the foot, at least one spoiler designed to grip the leg, and hingedly mounted on said shell;

means of clamping the shell and spoiler on the foot and the leg, which means are constituted by a buckle system comprising:

a lever secured to the shell or to the spoiler;

a clamping member connected to said lever;

a toothed piece secured on the part of the shell or spoiler which faces the part receiving the lever, said toothed piece being designed to cooperate with the clamping member.

The boot according to the invention is characterized in that:

the toothed piece is housed between two parallel side walls molded with the boot, and defining between them an open chamber on the edge of the spoiler or of the shell, and the height of which substantially coincides with the height of the toothed piece;

the end of said chamber is, on the one hand, extended at the top by a streamlined structure which is progressively joined to the front of the spoiler of the shell;

and on the other hand, comprises a split part, perpendicular to the walls and situated plumb with the beginning of said streamlined structure.

The clamping member is advantageously a buckle-shaped loop and the toothed piece housed inside said characteristic chamber is narrower than the chamber, to enable the engagement of the loop in the teeth;

the clamping member is a serrated strap which works with a catch, constituting the said toothed piece, housed in the characteristic chamber;

said toothed piece or catch is riveted (or clipped) in said chamber through an orifice provided to this effect;

when the clamping member is a serrated strap, the split part provided at the end of the chamber has a slightly greater length and width than the width and height of the serrated strap; advantageously, said strap comprises annular colored markings, designed to display the gripping tension, and thus to enable to balance said tension between the two feet;

the split part situated at the closed end of the chamber spreads over the entire width of the chamber.

The invention will be more readily understood on reading the following description with reference to the accompanying drawings illustrating two embodiments of the invention, one in which the clamping member is a serrated strap (rack+catch) (FIGS. 1 to 4), and the other in which the clamping member is a loop (FIGS. 5 to 7).

DETAILED DESCRIPTION OF THE INVENTION

Figure 1:
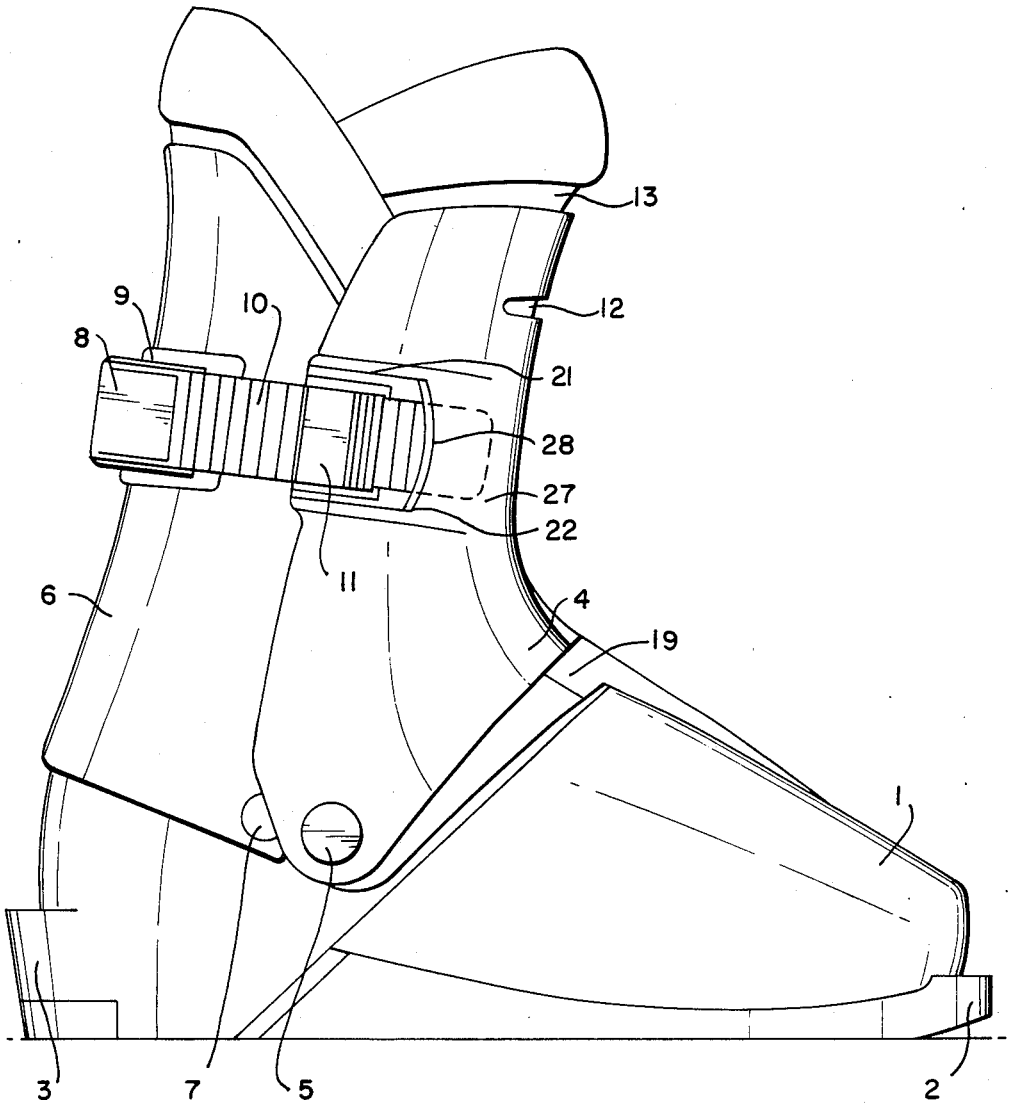
FIG. 1 is a diagrammatical side view of a boot according to the invention.

Referring now to the figures, the boot according to the invention essentially comprises, an injection-molded shell (1) in plastic material, in which the sole (2) and heel (3) are directly molded. In known manner, (see applicant's French Pat. No. 2,511,229), the front spoiler (4) is hingedly mounted on the shell (1) and the rear spoiler (6) is hingedly mounted in (7) thus forming a parallelogram deformable about its two pivots (5, 7). Said boot further comprises a split part (12) provided at the front of the spoiler (4) as well as a slipper (13).

In the first embodiment illustrated in FIG. 1, the boot comprises only one buckle system constituted essentially by a lever (8) associated to a toggle member (9) wherefrom begins a serrated strap (10) in plastic material, which cooperates with a catch (11) produced with releasing kinematics.

Figure 2:
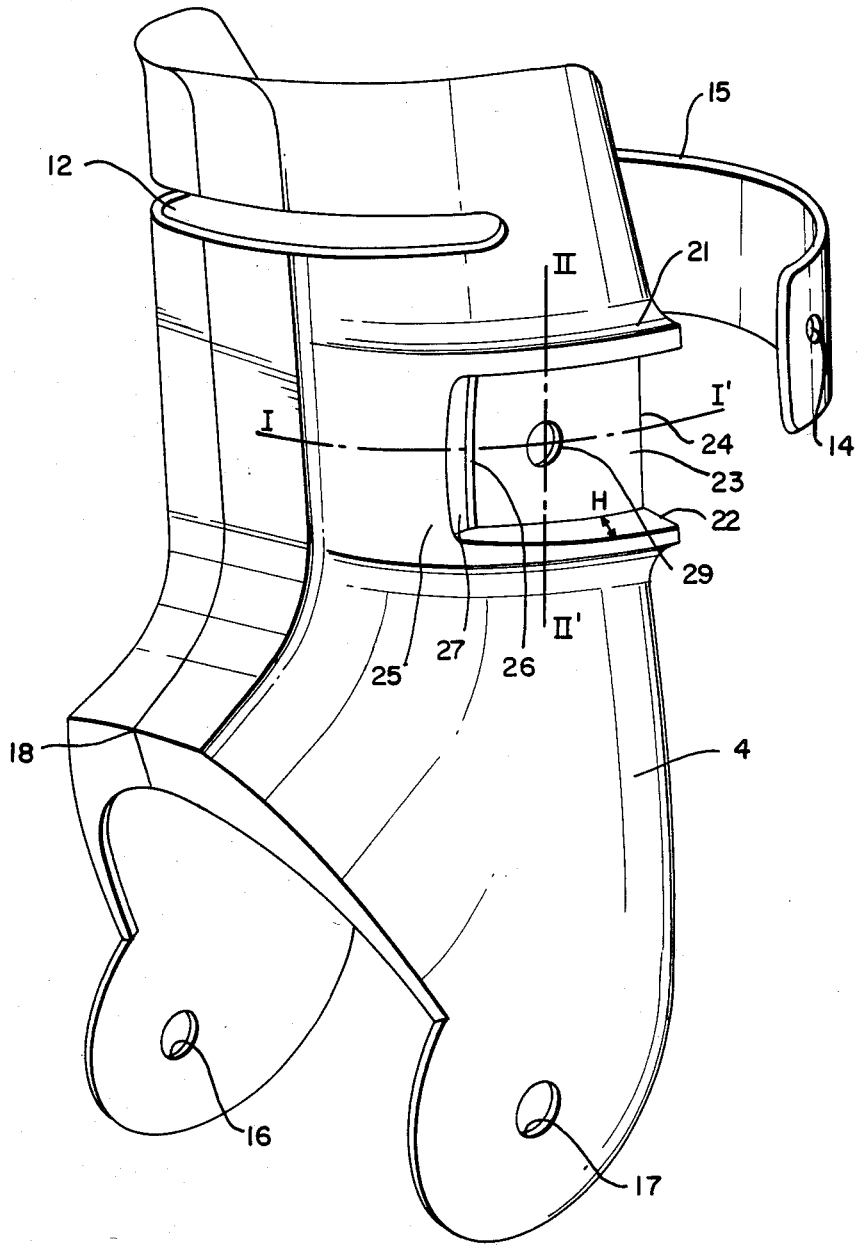
FIG. 2 is a diagrammatical perspective view illustrating the front spoiler according to the invention.
Figure 4:
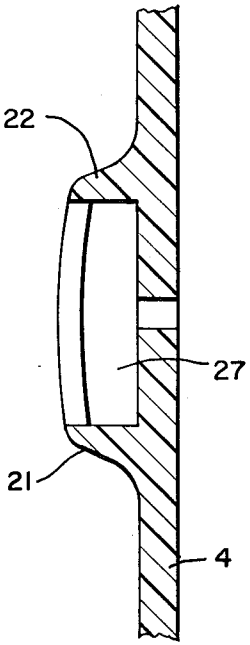
FIGS. 3 and 4 are detailed illustrations taken along axes I—I' and II—II' of FIG. 2.
Figure 3:
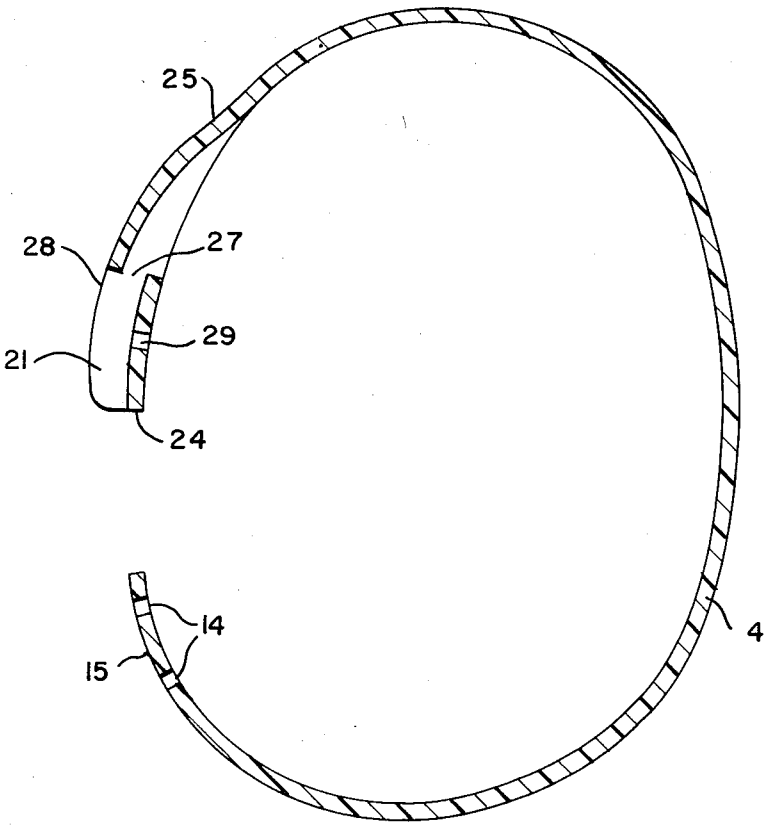

The level (8) of the buckle system is secured by rivets on a base, through orifices (14) provided to this effect in the fastening lug (15) of the lever which is integral with the spoiler (4) (see FIG. 2). Said spoiler (4) comprises at its lower part, two orifices (16, 17) designed to receive the pivot pin (5). The front (18) of the spoiler comes to rest against a gusset (19) or the like provided to this effect in the shell (1).

According to the present invention, the base of the catch (11) is housed between two parallel side walls (21, 22) molded directly on the spoiler (4) and defining together an open chamber (23) on the edge of the spoiler (4), the height H of which chamber coincides substantially to that of the catch (11). The end of said chamber which faces the open edge (24) is extended at the top by a streamlined structure (25) which is gradually joined to the rest of the spoiler (4) towards the front, and designed to cover the strap (10) jutting out of the catch (11). The inner edge (26) of chamber (23) which is in opposed relation to open edge (24) contains a split part (27) which is perpendicular to walls (21, 22), said split part being plumb with the start (28) of the streamlined structure (25). Said split part (27) is designed to allow the strap (10) to penetrate into the structure (25), and thus to ensure tightness. Its width and length should be slightly greater than the width and thickness of the strap (10). An orifice (29) enables to rivet the base of catch (11) in chamber (23). Likewise, the height of said chamber (23) and of the streamlined structure (25) decreases gradually first from the open side (24) to the split part (27), then from the beginning of structure (25) to the junction with the front of the spoiler (4). According to a practical embodiment, the two walls (21, 22) are at 25 mm one from the other, the length of chamber (23) is 40 mm and its depth is about 10 mm at the level of edge (24) and 7 mm at the level of the split part (27).

Although in the illustrated example, the streamlined structure characteristic of the invention is provided on the spoiler, it could also be provided on the shell proper, even on the rear spoiler, if the boot has one.

The invention is used as follows:

The skier, in conventional manner, engages the strap (10) under the catch (11) until the required tightening is obtained. Tightening tension may be predetermined either by providing colored markings on the strap (10) or even better by providing annular elements movable on the strap (10). This particular disposition advantageously guarantees a constant tightening tension for the two feet. The free end of the strap (10) is thereafter slidably pushed through the split part (27) under the streamlined structure (25).

Figure 6:
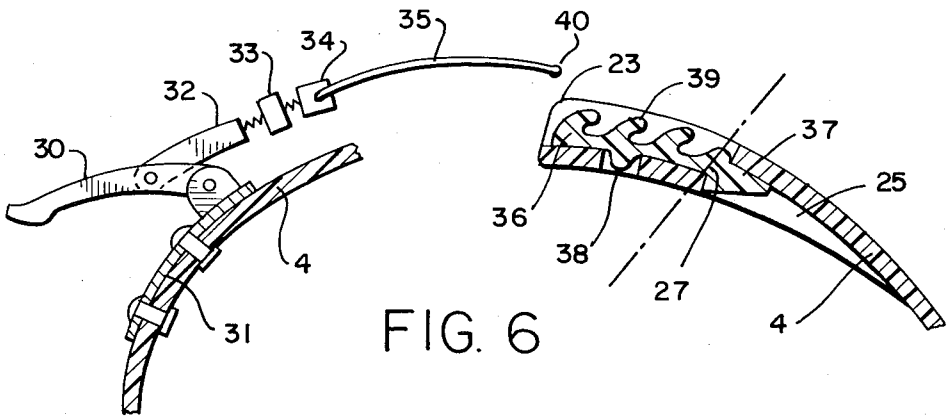
FIGS. 6 and 7 show the same cross-sections of that second embodiment as FIGS. 3 and 4.
Figure 7:
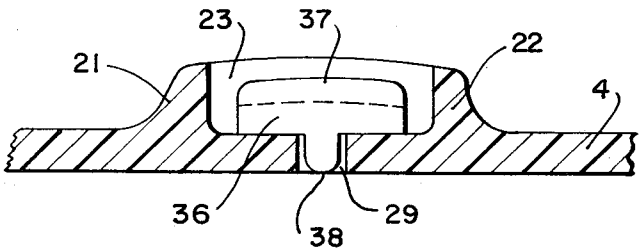
Figure 5:
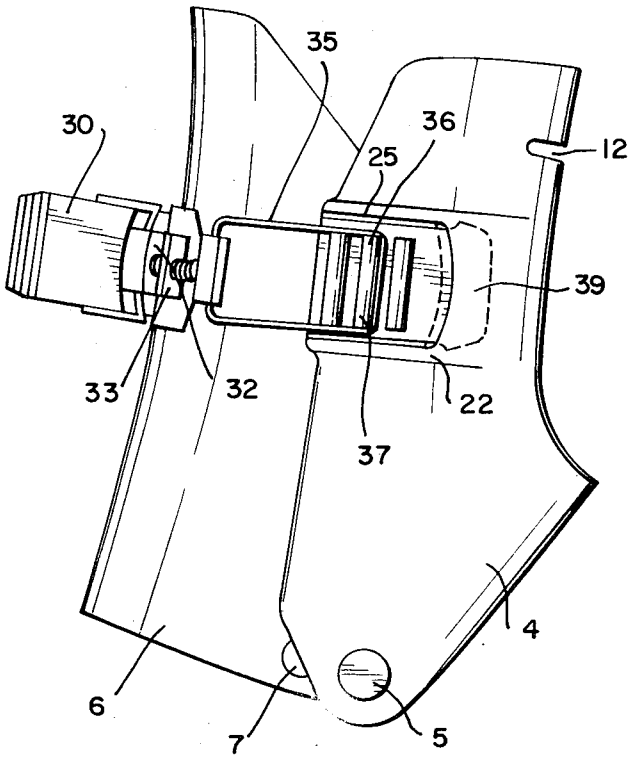
FIG. 5 is a succinct illustration of the side view of the second embodiment.

In the second embodiment illustrated in FIGS. 5 to 7, the same references have been used. Here, the clamping system is constituted by a buckle system comprising essentially a lever (30) riveted to the shell (4) via a base member (31). Said lever (30) actuates a toggle member (32) integral with a tangent screw (33) which, by way of a piece (34) actuates a closed loop (35) in steel wire. The aerodynamic-shaped characteristic chamber (23) (see FIG. 6) placed on the shell (4) opposite the lever (30) comprises a toothed part (36) in rigid injected plastic material, the height of which coincides also with that of the chamber. Said part (36) which comprises fastening teeth (37) facing the opposite direction, is connected with the shell (4) by means of a clipping-in lug (38) which is engaged in orifice (29). The end (39) of said toothed part (36) which is permanently engaged under the streamlined structure (25) has the shape of a hook which is brought to rest on the split part (27) to ensure the pulling strength and tearing strength of the piece (36).

This disposition enables ready replacement of the part (36) and facilitates the fitting of the loop (35) and more specifically of its end (40) on the teeth (37).

The device according to the invention has many advantages, and in particular:

in cases of accidental shocks on the toothed part, the risk of opening is limited;

the clamping member is no longer protruding;

because of the chamber, the toothed fastening piece is protected from the snow and;

the appearance is greatly improved.

As we have already indicated, this device may be used with different designs of plastic ski boots, and more precisely, either on the front spoiler for boots opening at the back, or on the upper flap or the shell for boots opening in the conventional way, and this regardless of whether the clamping system uses a serrated strap or a loop.

What I claim is:

1. A ski-boot comprising:

a shell adapted to receive a foot and a leg;

a spoiler mounted by hinges on said shell;

means for clamping said shell and said spoiler on said foot and said leg, said clamping means including a buckle system comprising a lever secured to said spoiler, a serrated strap connected to said lever, and a catch designed to cooperate with said strap secured on a part of said spoiler;

a chamber housing said catch, said chamber being defined by two parallel side walls molded on said spoiler, the height of said chamber coinciding with the height of said catch; and said chamber being extended by a streamlined structure gradually conforming to the remainder of said spoiler towards its front, and including an opening perpendicular to said two side walls plumb with an edge of said streamlined structure, said opening being adapted to accomodate a free end of said serrated strap under said streamlined structure.

2. A ski-boot according to claim 1, wherein said opening provided in said chamber spreads over an entire width of said chamber and has a slightly greater length and width than the width and height of said serrated strap.

* * * * *